US009868017B2

(12) United States Patent
Bertolutti

(10) Patent No.: US 9,868,017 B2
(45) Date of Patent: Jan. 16, 2018

(54) EXERCISE APPARATUS

(71) Applicant: Roman Bertolutti, Kelowna (CA)

(72) Inventor: Roman Bertolutti, Kelowna (CA)

( * ) Notice: Subject to any disclaimer, the term of this patent is extended or adjusted under 35 U.S.C. 154(b) by 0 days.

(21) Appl. No.: 14/983,360

(22) Filed: Dec. 29, 2015

(65) Prior Publication Data

US 2017/0182353 A1 Jun. 29, 2017

(51) Int. Cl.

| | |
|---|---|
| ***A63B 23/12*** | (2006.01) |
| ***A63B 21/00*** | (2006.01) |
| ***A63B 21/04*** | (2006.01) |
| ***A63B 21/062*** | (2006.01) |

(52) U.S. Cl.

CPC .... *A63B 21/4035* (2015.10); *A63B 21/00061* (2013.01); *A63B 21/0442* (2013.01); *A63B 21/063* (2015.10)

(58) Field of Classification Search

CPC ..... A63B 21/0552; A63B 21/0555; A63B 21/0557; A63B 21/4035

See application file for complete search history.

(56) References Cited

U.S. PATENT DOCUMENTS

| | | | | |
|---|---|---|---|---|
| 3,119,614 | A | 1/1964 | Berry | |
| 3,256,015 | A | 6/1966 | Perrin | |
| 4,195,835 | A | 4/1980 | Hinds et al. | |
| 4,328,964 | A | 5/1982 | Walls | |
| 4,779,867 | A | 10/1988 | Hinds | |
| 4,949,956 | A | 8/1990 | Pobran | |
| 5,556,368 | A | 9/1996 | Akin | |
| 5,885,190 | A | 3/1999 | Reiter | |
| 5,885,196 | A | 3/1999 | Gvoich | |
| 6,120,424 | A | 9/2000 | Arline | |
| 6,652,419 | B1 | 11/2003 | Rota | |
| 6,676,576 | B1 | 1/2004 | Wu | |
| 7,326,157 | B2 | 2/2008 | Wu | |
| 8,348,814 | B1 | 1/2013 | Hinds et al. | |
| 9,079,062 | B2 * | 7/2015 | Thomas | A63B 21/0442 |
| 2014/0073496 | A1 | 3/2014 | Bannerman | |

* cited by examiner

*Primary Examiner* — Loan H Thanh

*Assistant Examiner* — Rae Fischer

(74) *Attorney, Agent, or Firm* — Richard D. Okimaw

(57) ABSTRACT

An exercise apparatus comprises an elongate support member extending along a length between first and second ends. The rigid member has a passage extending therethrough between the first and second ends. The apparatus further comprises a handle extending between first and second handle ends, the handle having connectors proximate to each of the first and second ends and a grip section therebetween and at least one elongate flexible member extending through the passage of the support member and having end connectors on each end thereof, the at least end connectors being connectable to one of the connectors of the handle.

18 Claims, 7 Drawing Sheets

EXERCISE APPARATUS

BACKGROUND OF THE INVENTION

1. Field of Invention

The present invention relates generally to exercise and in particular to a method and apparatus for permitting a user to exercise without interfering with their range of motion.

2. Description of Related Art

Many forms of exercise require a user to grasp and manipulate a handle against a resistance. One common way to do this is to suspend the handle from a cable or the like. One disadvantage that exists with common exercise equipment is that the center of the handles are frequently aligned with the cable such that the cable may interfere with and overlap the path of at least part of the user's body. Accordingly, it will be appreciated that a user will therefore be limited in the movements that they are able to perform with such equipment.

Attempts have been made to provide a handle with connections at each end. However such devices may commonly rely upon connecting the handle to two cables each having their own weight stack. It has been found that such devices may be unstable due to the differences in motion between the two weight stacks.

Additionally, other attempts have been made to replace the cables and weights with elastics. Such elastics commonly extend from a common source such as a connection point or bar to the handle. However, as elastics rely upon their length to stretch to provide the required resistance, it has been found that relatively long elastics have been required. Therefore the handle is often required to be spaced away from the connection point or bar by a relatively long distance which makes such devices cumbersome.

SUMMARY OF THE INVENTION

According to a first embodiment of the present invention there is disclosed an exercise apparatus comprising an elongate support member extending along a length between first and second ends, the rigid member having a passage extending therethrough between the first and second ends, a handle extending between first and second handle ends, the handle having connectors proximate to each of the first and second ends and a grip section therebetween and at least one elongate flexible member extending through the passage of the support member and having end connectors on each end thereof, the at least end connectors being connectable to one of the connectors of the handle.

Each of the first and second ends of the support member may include arcuate portions curving away from an axis of the passage. The support member may further include a mounting location extending from a top portion thereof for supporting the support member from a body. The mounting location may extend from the support member in an opposite direction to the arcuate portions. The mounting location may comprise a plate extending from the support member having a bore therethrough. The mounting location may comprise a bore passing through the elongate support member. The body may comprise a cable. The passage may include a slot extending through the elongate member proximate to the mounting location. The slot may extend along an opposite side of the elongate member from the arcuate portions.

The handle may comprise a plurality of end connectors proximate to each end thereof. The connectors of the flexible member may comprise an enlarged body located proximate to an end thereof. Each of the connectors of the handle may comprise a slot having at least one receiving location adapted to receive and retain the enlarged end of the flexible member. The connectors may include a plurality of receiving locations with narrowed portions therebetween. The narrowed portions and the receiving locations may include rounded transitions therebetween. Each of the slots may include an enlarged entrance location sized to permit the enlarged body to pass therethrough. The connectors may comprise a pair of slots extending towards each other from the entrance locations.

The flexible members may be elastic. The exercise apparatus may further comprise a plurality of flexible members. Each of the plurality of flexible members may have a different elastic modulus. Each of the plurality of may have flexible members a different color.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
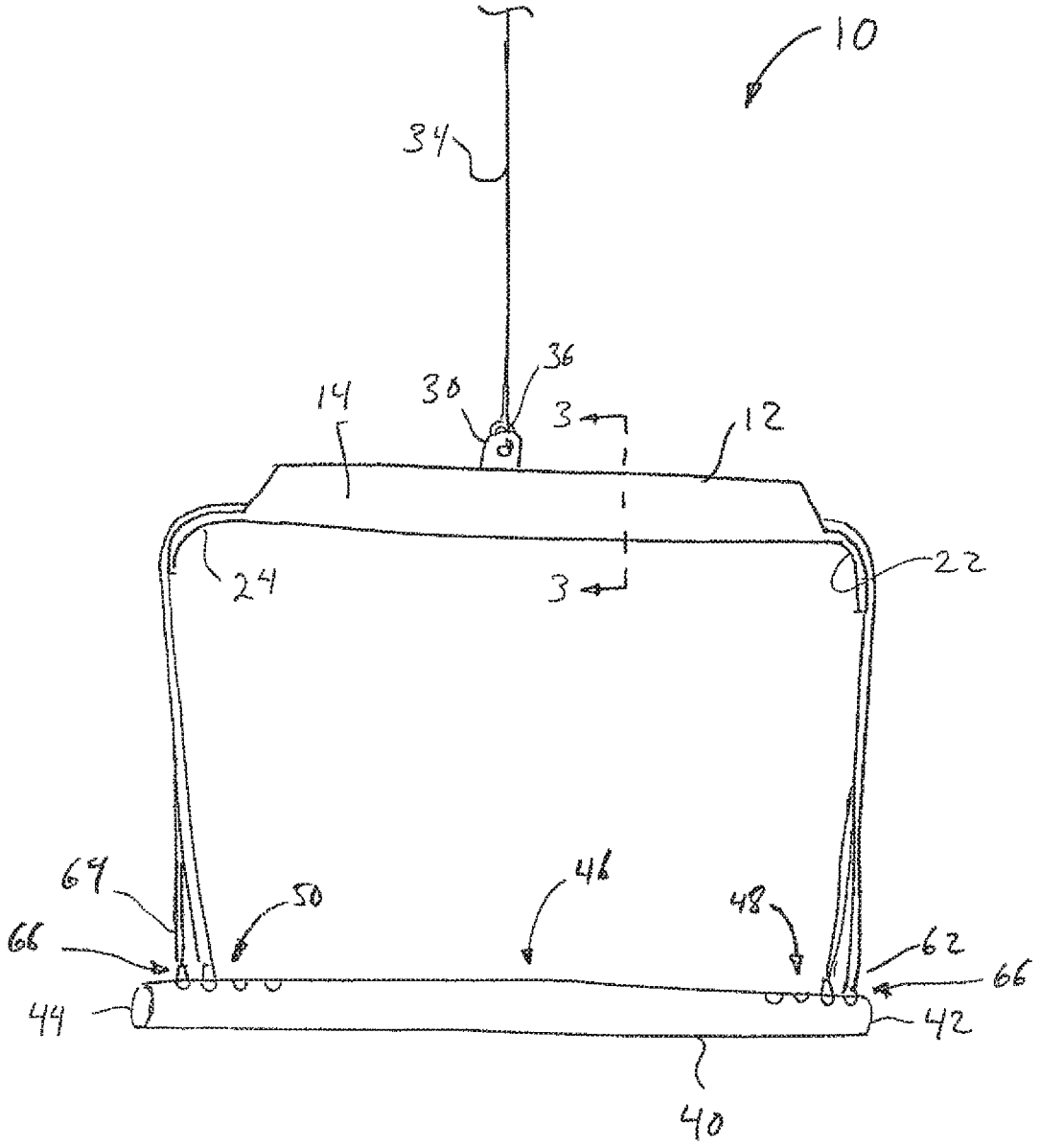
FIG. 1 is a perspective view of an exercise apparatus according to a first embodiment of the present invention.

Referring to FIG. 1, an exercise apparatus according to a first embodiment of the invention is shown generally at 10. The apparatus 10 comprises a top support 12, a handle 40 spaced there below and at least one flexible member 60 extending therebetween. In operation the user secures the top support 12 to a surface or body and grasps the handle 40 between the flexible members such that their range of motion of their arm is not impeded by the flexible members as will be more fully described below.

Figure 2:
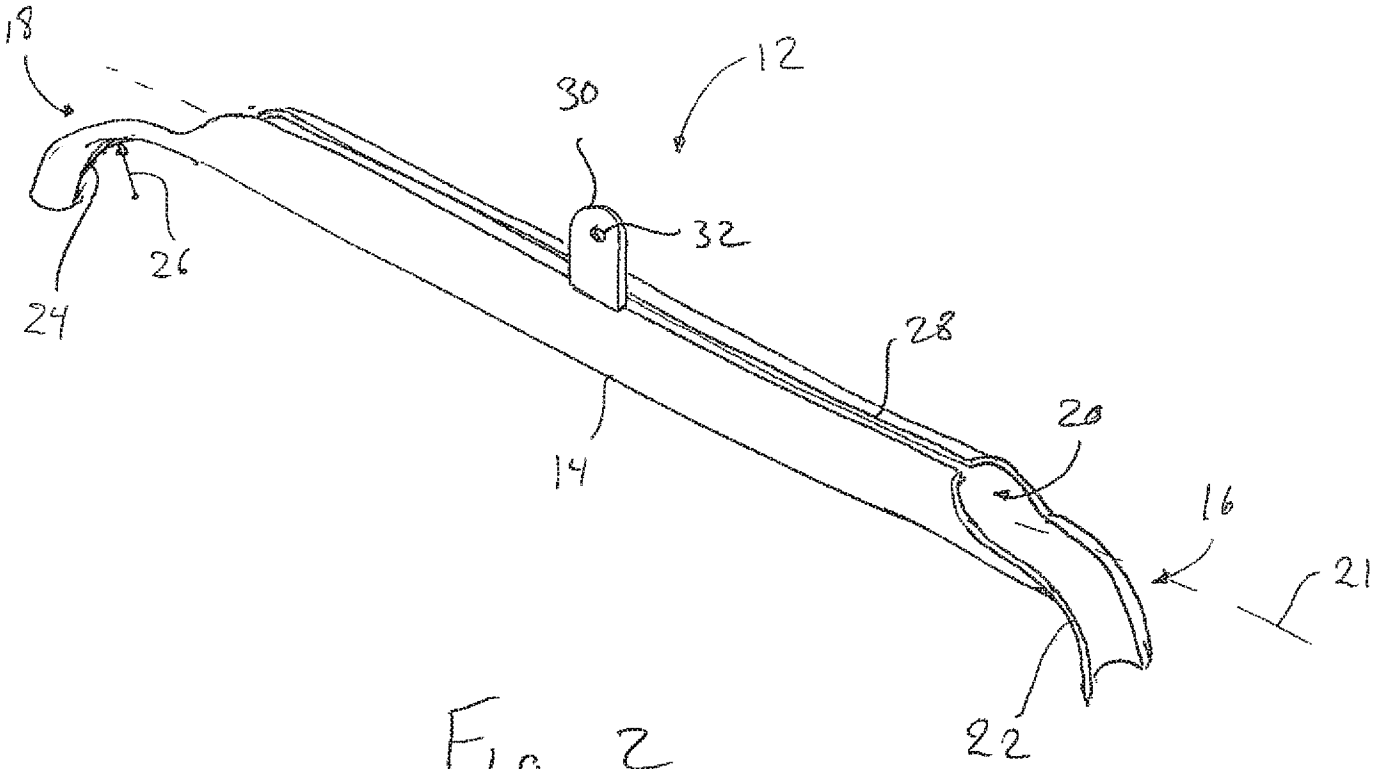
FIG. 2 is a perspective view of the top support of the exercise apparatus of FIG. 1.

Turning now to FIG. 2, the top support 12 comprises an elongate tubular body 14 extending between first and second ends, 16 and 18, respectively. the tubular body 14 defines a passage 20 therethrough having a slot 28 extending thereallong so as to permit the flexible members to be passed into the passage 20. As illustrated in FIGS. 1 and 2, the first and second ends 16 and 18 may include arcuate portions, 22 and 24, respectively curving away from a central axis 21 of the passage 20. The arcuate portions 22 and 24 have a radius of curvature 26 selected to reduce stress and provide free motion of the flexible members thereover as will be more fully described below. In practice it has been found that a radius of between ½ and 8 inches (13 and 203 mm) has been useful although it will be appreciated that other dimensions may be useful as well.

The top support 12 includes a mounting location 30 adapted to permit the top support 12 to be suspended from an object. As illustrated in FIGS. 1 and 2, the mounting location 30 may comprise a tab extending from the tubular body proximate to the slot 28. The tab may include a bore 32 therethrough operable to receive a clip 36 such as a carabiner or the like. As illustrated in FIG. 2, the clip 36 may be secured to the end of a cable 34 such that the cable suspends the top support 12 at the location desired by a user. The mounting location 30 is located at the middle of the tubular body 14 such that the top support 12 will be balanced when supported by the mounting location.

Figure 6:
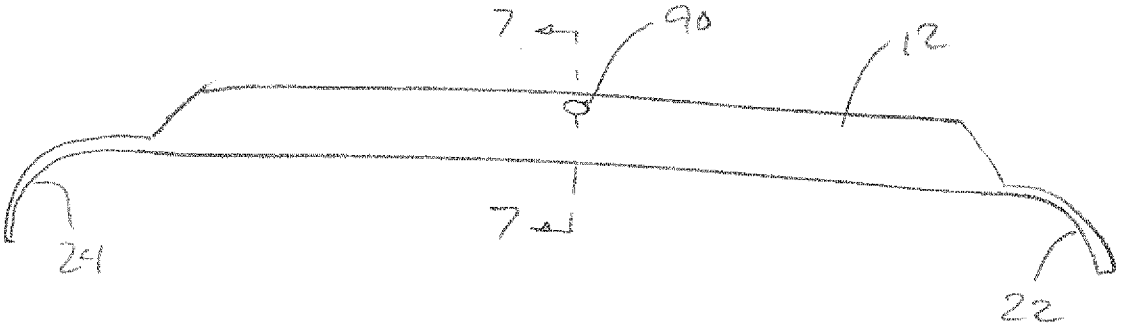
FIG. 6 is a perspective view of a top support of the exercise apparatus according to a further embodiment.
Figure 7:
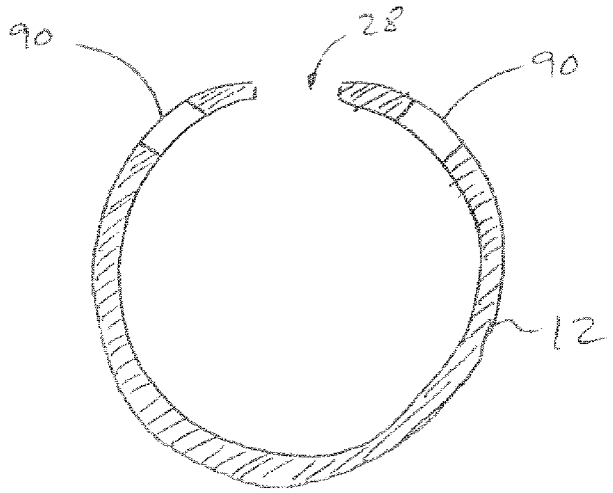
FIG. 7 is a cross sectional view of the top support of the exercise apparatus of FIG. 6 as taken along the line 7-7.

Optionally, as illustrated in FIGS. 6 and 7, the mounting location may comprise one or more bores 90 passing through the top support 12 to either side of the slot 28 so as to be operable to receive a clip, hook or the like therein. In operation, the clip or hook may be passed through one or both of bores 90.

Figure 3:
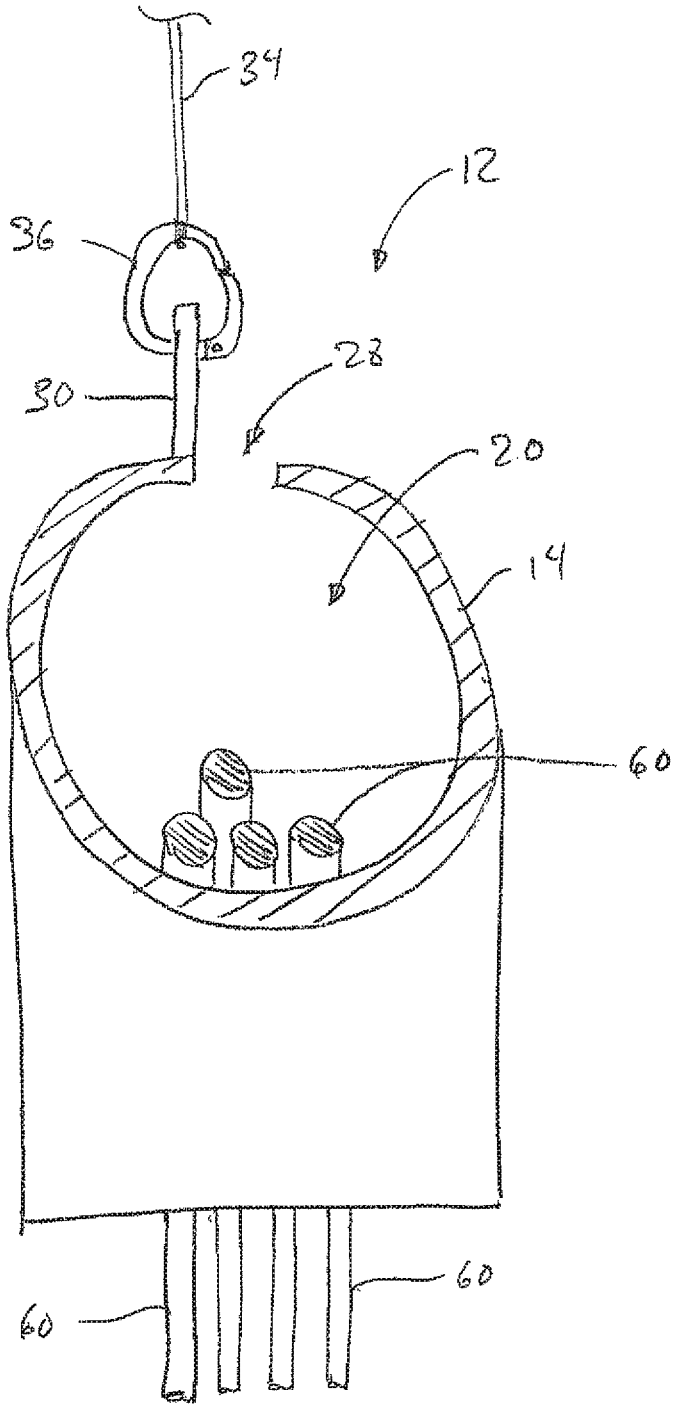
FIG. 3 is a cross sectional view of the top support of the exercise apparatus of FIG. 1 as taken along the line 3-3.

Turning now to FIG. 3, a cross sectional view of the top support is illustrated. As illustrated, the tubular body 14 of the top support may have a substantially circular cross section however it will be appreciated that other cross section profiles may also be useful such as, by way of non-limiting example, oval, square, triangular or irregular. As illustrated, one or more flexible members may extend through the passage 20 to connect to each end of the handle, as will be more fully described below.

With reference to FIG. 1, the handle 40 comprises an elongate rigid member extending between first and second ends, 42 and 44 respectively with a grip portion 46 therebetween. Proximate to each of the first and second ends 42 and 44 are connectors, 48 and 50, the details of which will be further described below for connection to the flexible members 60.

Figure 4:
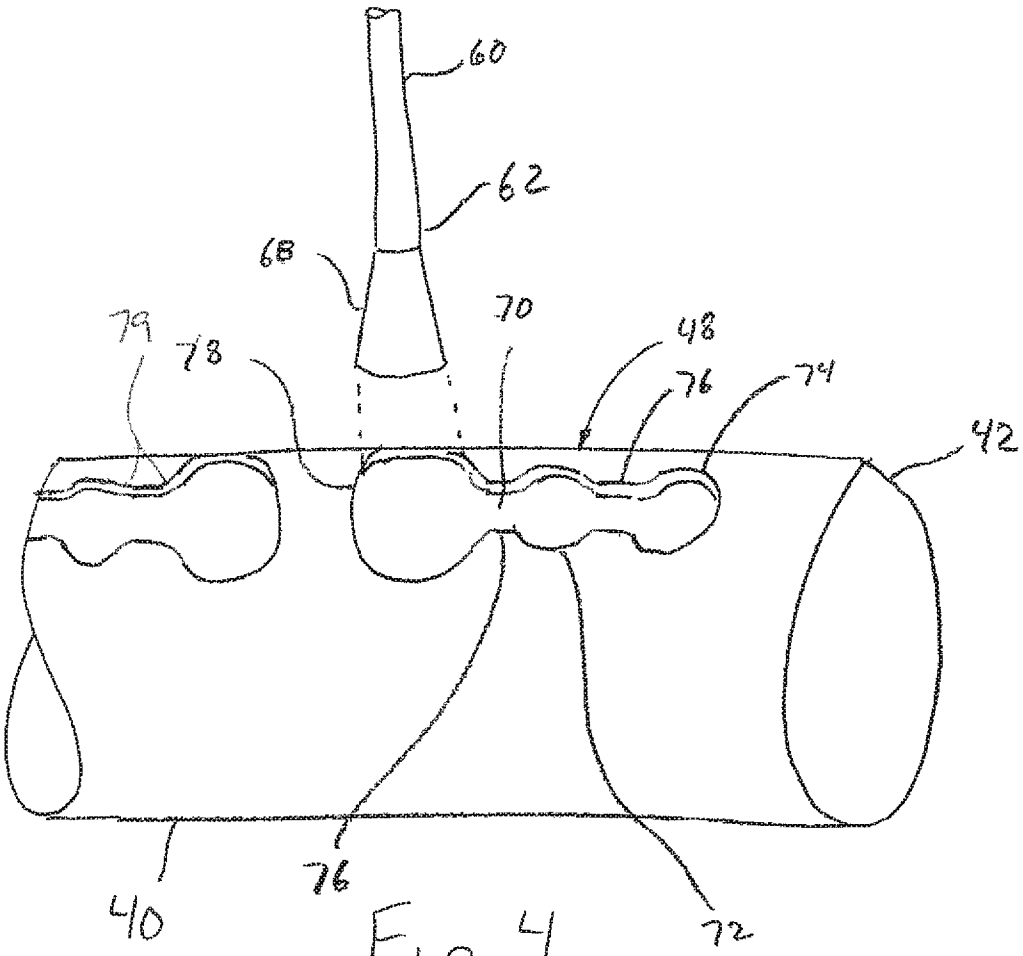
FIG. 4 is a detailed exploded view of the connectors between the elastic members and the handle of the exercise apparatus of FIG. 1.

The flexible member extends between first and second ends, 62 and 64, respectively. Each of the first and second ends 62 and 64 includes an end connector 66 for connection to the connectors 48 and 50 of the handle. As illustrated in FIG. 1, the flexible member 60 is passed through the passage 20 of the handle such that the end connector 66 at the first end 62 is connected to the connector 48 of the first end 42 of the handle. Similarly, the end connector 66 at the second end 64 is connected to the connector 50 of the second end 44 of the handle. In such a manner the flexible member 60 suspends the handle 40 below the top support 12. As illustrated in FIG. 4, the connector may comprise a flared end 68 sized to have a non-deformable thickness greater than the thickness of the flexible member as are commonly known.

The flexible member 60 may be elastic, such as by way of non-limiting example, formed of rubber, silicon or the like as are commonly known. The flexible member 60 may selected to have a thickness and resilience to provide a desired biasing force under stretch for the exercise to be provided. The flexible member 60 is permitted to stretch along its entire length during exercise such that the portion within the passage 20 as well as the portions between the top support 12 and the handle 40 are permitted to stretch to provide the desired resistance. In such manner, a more consistent biasing force is provided and a reduced distance may be provided between the handle and the top support. As illustrated in FIG. 1, a plurality of flexible members 60 may be provided to enable a user to adjust the resistance provided upon the handle for each exercise. Additionally, each of the resilient members may be provided with a different modulus of elasticity so as to provide a different level of resistance for a user so as to enable the user to customize, through selecting different combinations of the elastic members, the level of total resistance provided. It will be appreciated that each different level of resistance may be coloured a different colour to assist the user in differentiate between the different levels of resistance. Optionally, the flexible member may be selected to be non elastic such that the average distance between the top support 12 and the handle 40 remains constant while permitting the handle to rotate relative to the top support through sliding the flexible members through the passage 20. Such arrangement will be useful for suspending the top support 12 from a cable connected to a weight stack for use in ex Turning now to FIG. 4, one embodiment of the connection between the flexible members 60 and the handle 40 is illustrated. As set out above the ends of the flexible member 60 include flared non-deformable bodies having a width greater than the width of the flexible member. The handle 40 may be substantially hollow wherein the first connector 48 of the handle comprises a slot 70 extending into the handle 40. The slot 70 includes one or more receiving locations 72 and 74 comprising a bore sized to have a diameter between the flexible member and the diameter of the flared end 68. In such a manner, the flexible ember may pass through the receiving location 72 or 74 while the flared end 68 is retained therein. The slot 70 also includes an entrance 78 sized larger than the flared end 68 such that the flared end 68 may be freely passed therethrough into the interior of the handle. The receiving locations 72 and entrance 78 may include narrowed portions 76 therebetween to differentiate between such locations and retain the flared end 68 within the receiving locations as desired. As illustrated, the receiving locations and narrowed portions may include a rounded transition 79 therebetween. In operation, a user may pass the flared end 68 through the entrance 78 and thereafter slide the flexible member to the desired receiving location. Thereafter pulling the flexible member 60 away from the handle will set the flared end 68 within the desired receiving location providing a secure fit between.

Figure 5:
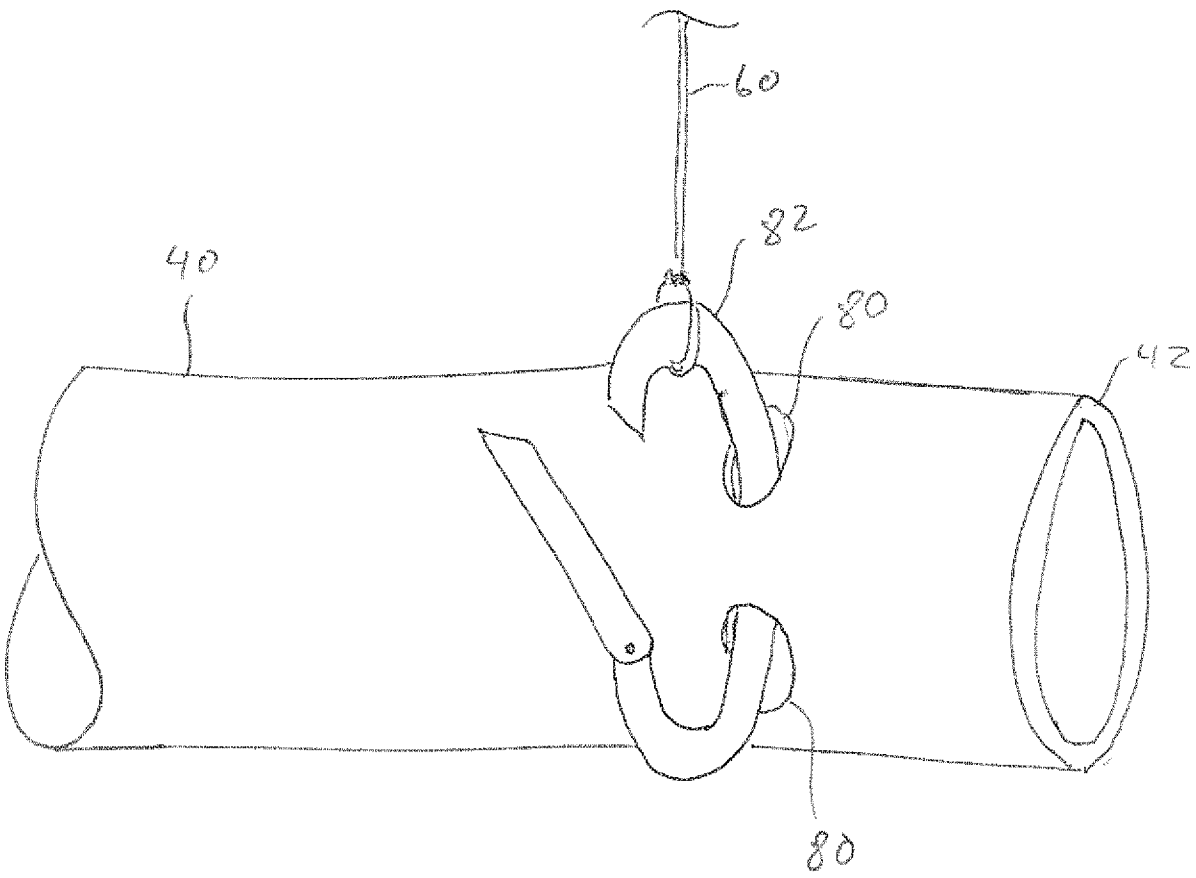
FIG. 5 is a detailed exploded view of the connectors between the elastic members and the handle of the exercise apparatus of FIG. 1 according to a further embodiment.

Although one style of connection between the flexible member and handle is illustrated and set out above, it will be appreciate that other styles of connections may also be utilized, such as by way of non-limiting example, hooks, carabineers 82 as illustrated in FIG. 5 or the like. In particular, as illustrated in FIG. 5, the handle 40 may include a pair of bores 80 extending transversely through the handle so as to permit a carabiner 82 or the like to be passed therethrough. The carabiner 82 may then in turn be connected to a flexible member 60 through any known means. As illustrated in FIG. 5, the bores 80 may be aligned so as to form a path through the handle 40 offset from the center thereof. As illustrated in FIG. 4, the connectors 48 is provided with two receiving locations 72 and 74. To reduce the deforming of the slot 70 due to long lengths of such structures, if additional receiving locations are desired, more than one slot may be provided as illustrated in FIG. 4.

While specific embodiments of the invention have been described and illustrated, such embodiments should be considered illustrative of the invention only and not as limiting the invention as construed in accordance with the accompanying claims.

What is claimed is:

1. An exercise apparatus comprising:

an elongate rigid support member extending between first and second elongate rigid support member ends and having a passage extending between the first and second elongate rigid support member ends;

a handle extending between first and second handle ends, the handle having a connector proximate to each of the first and second handle ends and a grip section between the handle ends; and an elongate flexible member extending through the passage of the elongate rigid support member, wherein the elongate flexible member comprises two ends, each having an attached end connector configured for joining to one of the connectors of the handle so as to suspend the handle below and substantially parallel to the elongate rigid support member.

2. The exercise apparatus of claim 1, wherein each of the first and second elongate rigid support member ends includes an arcuate portion curving away from an axis of the passage.

3. The exercise apparatus of claim 2, wherein the elongate rigid support member further includes a mount extending from a top portion of the elongate rigid support member for supporting the elongate rigid support member from an external object.

4. The exercise apparatus of claim 3, wherein the mount extends from the elongate rigid support member in an opposite direction to the arcuate portions.

5. The exercise apparatus of claim 3, wherein the mount comprises a plate extending from the elongate rigid support member having a bore extending through the plate.

6. The exercise apparatus of claim 3, wherein the mount comprises a plate having a bore extending through the plate.

7. The exercise apparatus of claim 3, wherein the mount is configured to support the elongate rigid support member from a cable.

8. The exercise apparatus of claim 2, further comprising a slot extending through the elongate rigid support member proximate to the mount.

9. The exercise apparatus of claim 8, wherein the slot extends along an opposite side of the elongate rigid support member from the arcuate portions.

10. The exercise apparatus of claim 1, wherein each end connector of the elongate flexible member comprises an enlarged body.

11. The exercise apparatus of claim 10, wherein each connector of the handle comprises a slot having a receiver adapted to receive and retain the enlarged body of the elongate flexible member connector.

12. The exercise apparatus of claim 11, wherein each connector of the handle includes a plurality of receivers and a narrowed portion between each pair of receivers.

13. The exercise apparatus of claim 12, wherein the transition between each receiver and narrowed portion is rounded.

14. The exercise apparatus of claim 11, wherein each slot includes an enlarged entrance sized to permit said enlarged body to pass through.

15. The exercise apparatus of claim 1, wherein the elongate flexible member is elastic.

16. The exercise apparatus of claim 1, further comprising a second elongate flexible member.

17. The exercise apparatus of claim 16, wherein each elongate flexible member has a different elastic modulus.

18. The exercise apparatus of claim 17, wherein each elongate flexible member has a different color.

* * * * *